United States Patent [19]

Kufrin

[11] Patent Number: 4,877,185

[45] Date of Patent: Oct. 31, 1989

[54] OSCILLATING SPRINKLER

[75] Inventor: Fred W. Kufrin, Janesville, Wis.

[73] Assignee: Western Industries Inc., Milwaukee, Wis.

[21] Appl. No.: 948,123

[22] Filed: Dec. 31, 1986

[51] Int. Cl.[4] ..... B05B 3/16

[52] U.S. Cl. ..... 239/242; 74/837; 74/437; 74/393

[58] Field of Search ..... 239/240, 242, 237; 74/437, 600, 837, 393, 42

[56] References Cited

U.S. PATENT DOCUMENTS

| | | | |
|---|---|---|---|
| 2,700,285 | 1/1955 | Bellini | 74/437 |
| 3,047,241 | 7/1962 | McLhinney | 239/242 |
| 3,073,532 | 1/1963 | Rinkewich | 74/42 |
| 3,261,553 | 7/1966 | Kool et al. | 239/242 |
| 3,354,730 | 11/1967 | Thompson | 74/42 |
| 4,166,578 | 9/1979 | Skwara | 239/242 |
| 4,218,017 | 8/1980 | Gianfranco | 239/242 |

OTHER PUBLICATIONS

Machine Design, Cunningham, Designing and Using Noncircular Gears to Generate Mathematical Functions, 2/19/59, pp. 161–164.

Product Engineering, B. Bloomfield, "When You Need Noncircular Gears", Mar. 14, 1960.

*Primary Examiner*—Andres Kashnikow
*Assistant Examiner*—Chris Trainor
*Attorney, Agent, or Firm*—Andrus, Sceales, Starke & Sawall

[57] ABSTRACT

An improved oscillating sprinkler comprising a frame having a sprinkler tube mounted for oscillating movement on the frame. An inlet water housing is mounted on the frame and supplies water to the sprinkler tube. The sprinkler tube is driven in an oscillating path by a crank arm, and an eccentric gear mechanism driven by the water being supplied to the sprinkler tube is operably connected to the crank arm. The eccentric gear mechanism is constructed to provide a variable speed output that balances the varible speed output of the crank arm to provide a substantially uniform velocity of oscillating movement for the sprinkler tube. The sprinkler also includes a mechanism for varying the effective length of the crank arm to change the arc of oscillation of the sprinkler tube, and a slip clutch mechanism interconnects the inner end of the sprinkler tube to the housing to permit the sprinkler tube to be manually rotated to shift the spray pattern to one side or the other.

18 Claims, 3 Drawing Sheets

OSCILLATING SPRINKLER

BACKGROUND OF THE INVENTION

In a conventional oscillating sprinkler, water entering the sprinkler drives a turbine which operates through a gear reduction system to drive a crank arm that is connected to the sprinkler tube. Rotation of the crank arm will thus oscillate the sprinkler tube through a given arc to move the spray pattern over the lawn. With a crank-type action, the velocity of the oscillation is greatest at the midpoint of the oscillating stroke and the velocity is at a minimum at the end portions of the stroke where the crank arm is at dead center position. Because of the variation in velocity, the discharge of water is not uniform throughout the oscillating stroke and a greater volume of water will be discharged at the end portions of the stroke which can result in "puddling" or overwatering.

In an attempt to provide a more uniform velocity throughout the entire area of oscillation, attempts have been made to incorporate a cam mechanism with the crank arm to reduce the velocity during the midportion of the oscillating stroke.

It is also desirable to be able to vary the magnitude or arc of the oscillating stroke of the sprinkler tube to accommodate different watering conditions. Similarly, it is advantageous to be able to shift the spray pattern to one side or the other of the axis of the sprinkler tube to direct the spray pattern to desired areas.

SUMMARY OF THE PRESENT INVENTION

The invention is directed to an improved oscillating sprinkler having a substantially uniform velocity throughout the oscillating stroke and having the ability to be readily adjusted to vary both the amplitude or arc of the oscillating stroke and the position of the spray pattern.

In accordance with the invention, the sprinkler includes a supporting base provided with an inlet fitting to be connected to a source of water under pressure. A conventional turbine drive unit is associated with the inlet fitting so that the incoming water will drive the turbine unit through a gear reduction system to rotate an output shaft.

The output shaft is connected to one of a pair of meshing elliptical qears while the other of the gears is connected to an inner disc that is mounted within a cup-shaped outer disc. Mounted for sliding movement on the face of the inner disc is a slide which is pivoted to one end of a connecting rod, while the opposite end of the connecting rod is connected to collar on the end of the sprinkler tube. The pivotal connection of the slide to the connecting rod is located off center with respect to the axis of rotation of the disc so that the connection acts as a crank to transmit the rotational movement of the disc into oscillating movement of the sprinkler tube.

The elliptical gears provide a non-uniform velocity for the disc which acts to balance or compensate for the non-uniform velocity provided by the crank arm mechanism, with the result that the sprinkler tube has a substantially uniform velocity throughout its stroke.

To vary the amplitude or arc of oscillation, the slide is provided with a follower that rides in a cam track in the outer disc. By manually rotating the outer disc, the slide will be moved relative to the axis of rotation of the inner disc to thereby vary the effective length of the crank arm and change the magnitude of the oscillating stroke.

As a further feature of the invention, the sprinkler tube can be manually rotated relative to the housing or base to shift the spray pattern. In this regard, the inner end of the sprinkler tube is provided with a coupling having a plurality of longitudinally extending serrations which are engaged with flexible fingers in a collar attached to the housing. By manually rotating the sprinkler tube, the serrations will deflect the fingers outwardly and yet the fingers will engage the serration to hold the sprinkler tube in the desired angular location. A stop formed on the coupling is movable within a slot in the collar to limit the amount of rotation of the sprinkler tube and regulate the shifting of the spray pattern.

The sprinkler of the invention, through use of the elliptical gears, enables the sprinkler tube to move with a substantially uniform velocity throughout the entire oscillating stroke, thereby providing a uniform volume of water discharge and preventing overwatering or "puddling" at the end portions of the stroke.

Through use of the slide and cam track, the spray pattern can be readily adjusted through an arc of about 10° to 90°.

Rotation of the sprinkler tube relative to the housing provides a convenient manner of shifting the spray to one side or the other to accommodate the desired lawn watering pattern.

Other objects and advantages will appear in the course of the following description.

DESCRIPTION OF THE DRAWINGS

The drawings illustrate the best mode presently contemplated of carrying out the invention.

In the drawings.

DESCRIPTION OF THE ILLUSTRATED EMBODIMENT

Figure 1:
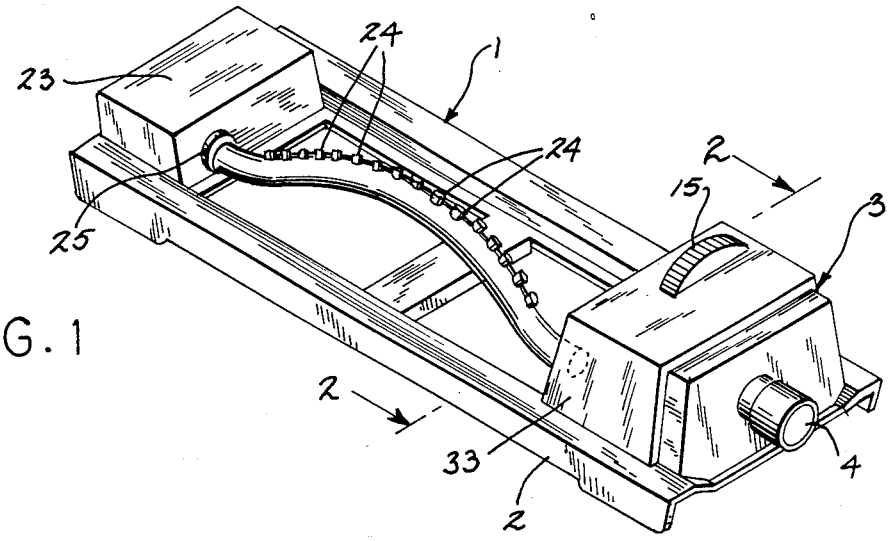
FIG. 1 is a perspective view of the sprinkler of the invention.
Figure 2:
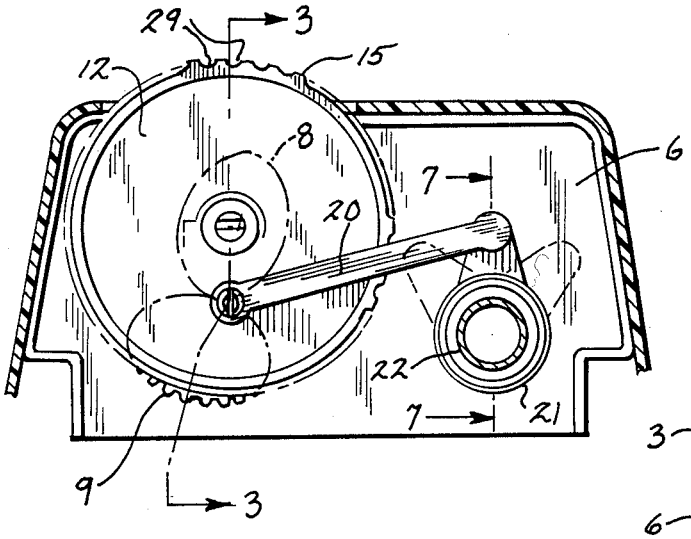
FIG. 2 is a transverse section taken along lines 2—2 of FIG. 1.

FIG. 1 illustrates a sprinkler 1 composed of a base 2 and a housing 3 is mounted on one end of the base. Housing 3 contains a water inlet fitting 4 which is adapted to be connected to a hose or other source of water under pressure. The water entering fitting 4 will operate through a conventional turbine type drive contained in the housing 2 to drive an output shaft 5. The turbine type drive is conventional and in itself forms no part of the present invention.

Output shaft 5 extends through an opening in internal divider wall 6 of housing 3 and is connected by screw 7 to an elliptical gear 8. Gear 8 is engaged with a second elliptical gear 9 that is mounted for rotation through bushing 10 on shaft 11 which is secured to wall 6. Gear 9 is secured to an inner disc 12 by a pair of lugs 13 that extend axially from disc 12 and are received in slots 14 in gear 9. Through use of the elliptical gears 8 and 9, the constant speed rotation of drive shaft 5 is transmitted into variable speed rotation for the disc 12.

Disc 12 is located within a cup-shaped outer disc 15 and the surface of disc 12 facing disc 15 is formed with a guideway 16 which receives a slide 17. Slide 17 is provided with an extended tail 18 which slides within an extension 19 of the guideway 16.

One end of a connecting rod 20 is mounted for rotation on slide 17 while the opposite end of connecting rod 20 is connected to a collar 21 that is mounted on the inner end of sprinkler tube 22. The outer end of sprinkler tube 22 is journaled for oscillating movement within a support 23 that extends upwardly from base 2.

Sprinkler tube 22 includes a plurality of upwardly extending outlets or jets 24 which are spaced on the length of the tube and the outer end of the tube is enclosed by removable clean-out plug 25.

Figure 3:
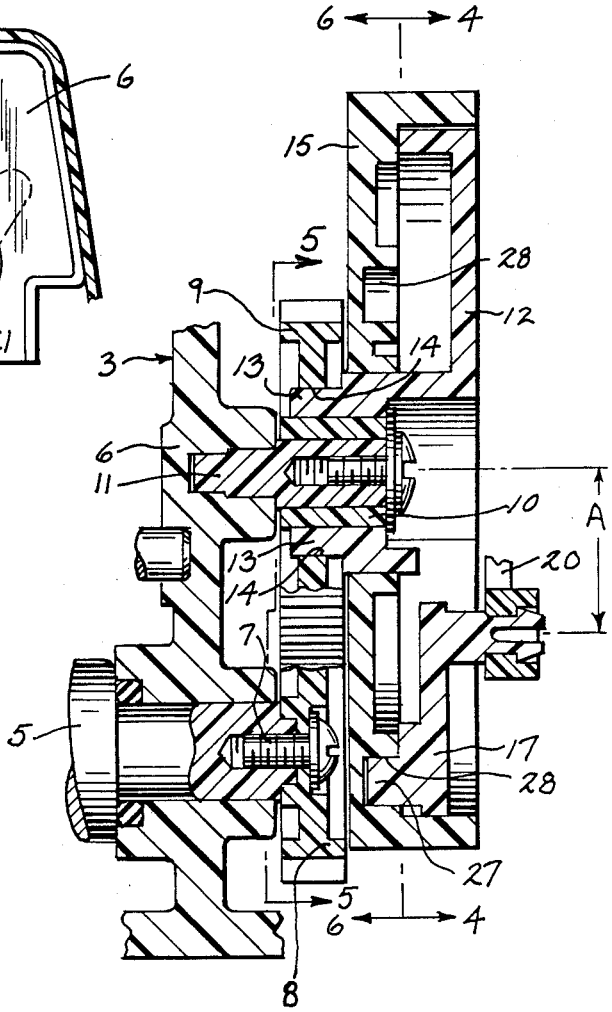
FIG. 3 is a section taken along lines 3—3 of FIG. 2.

Inner disc 12 along with slide 17 function as a crank arm, with the length of the crank arm being the distance between the axis of disc 12 and the pivotal connection of slide 17 to connecting rod 20 (shown by A in FIGS. 3 and 4), so that rotation of the disc will be transformed to oscillating movement for the collar and sprinkler tube 22. A crank arm produces a non-uniform velocity during the oscillating stroke. Similarly, elliptical gears will produce an output having non-uniform velocity. However, in the invention, the elliptical gears 8 and 9 are constructed and arranged so that the non-uniform velocity output of the gears balances or compensates for the non-uniform velocity of the crank arm so that the resultant velocity of sprinkler tube 22 will be substantially uniform throughout the oscillation cycle.

As a feature of the invention, the amplitude or arc of the oscillating stroke can be varied. To accomplish this adjustment, a follower 27 is mounted on slide 17 and is adapted to move within a generally spiral cam track 28 formed in the surface of disc 15 facing disc 12. By rotating outer disc 15, the cam mechanism will shift the position of the slide 17 relative to the axis of disc 12 with the result that the crank arm length A can be varied to correspondingly vary the amplitude of the oscillating stroke of the sprinkling tube 22.

Figure 4:
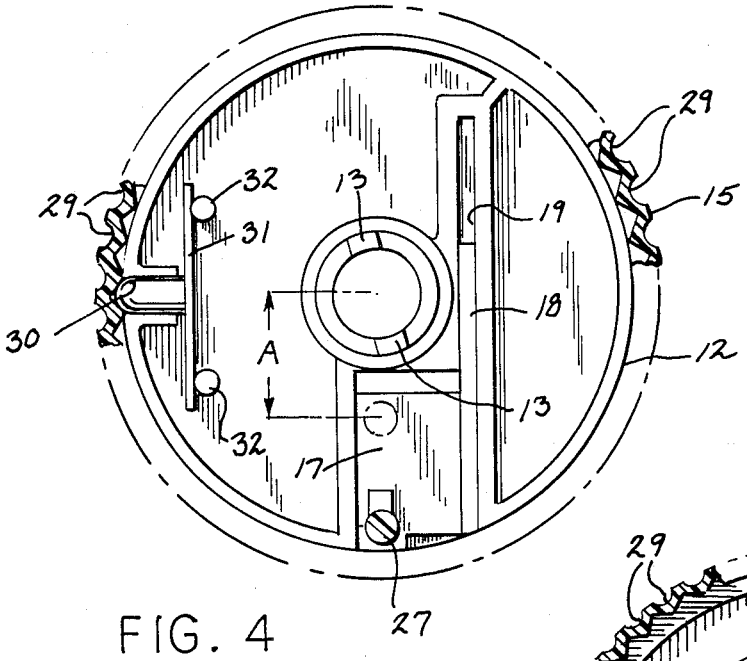
FIG. 4 is a section taken along lines 4—4 of FIG. 2.
Figure 6:
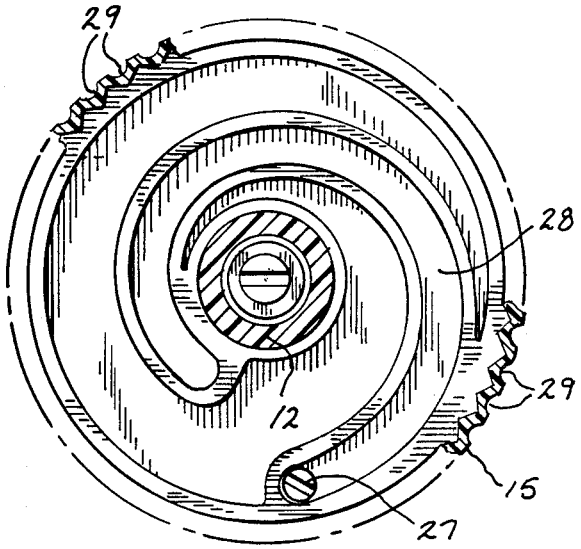
FIG. 6 is a section taken along line 6—6 of FIG. 3.
Figure 5:
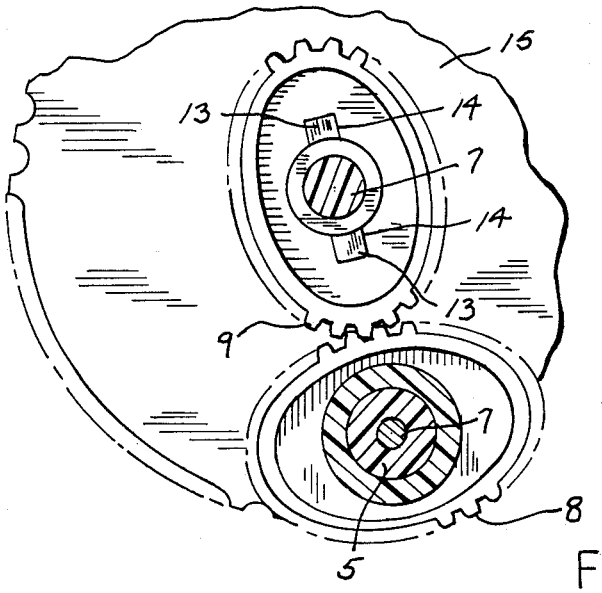
FIG. 5 is an exploded view of the connection between the end of the sprinkler tube and the housing.

The outer flange of disc 15 is provided with a plurality of grooves or serrations 29 and a detent 30 or pin, as shown in FIG. 4, having a curved outer end is engaged with the grooves 29 to position the inner disc 12 relative to outer disc 15. Detent 30 is biased outwardly by a flexible spring member 31 which is secured to the inner end of the detent. Spring member 31 extends laterally to either side of the detent and the ends of the spring member are engaged with stops 32. As the outer disc is manually rotated, the grooves 29 in the outer disc will depress the detent against the force of the spring member 31. As best shown in FIG. 1, the upper end of outer disc 15 projects through a slot in housing extension 33 and thus the outer disc can be manually rotated to vary the position of slide 17 and thus change the amplitude of the oscillating stroke of sprinkler tube 22.

As a further feature of the invention, sprinkler tube 22 can be manually rotated relative to housing 2 to shift the spray pattern being discharged through nozzles 24. To provide this function, the inner end of sprinkler tube 22 carries a coupling 34 that has a barbed split end 35 which is engaged within an opening in a bushing 36 mounted within an opening 37 in wall 6. Water entering housing 3 through fitting 4 will be discharged from the housing through coupling 34 to sprinkler tube 22.

Collar 21, which is pivotally connected to connecting rod 20, is secured around coupling 34 so that oscillation of collar 21 will be transmitted through coupling 34 to sprinkler tube 22. The outer end of collar 21 is formed with a pair of elongated flexible fingers 38, each of which is defined by a pair of parallel slots. The outer end of each finger 38 is provided with an inwardly projecting edge 39 that is engaged with serrations 40 formed on the outer surface of coupling 34. The engagement of the fingers 38 with the serrations acts as a clutch mechanism to permit the coupling 34 and sprinkler tube 22 to oscillate with oscillation of the outer collar 21. However, by manually grasping and rotating sprinkler tube 22, the tube can be rotated relative to collar 21 to shift the nozzles 24 so that instead of the spray pattern extending from one side of the axis of the sprinkler to the other, the pattern can be directed only to one side or the other as desired.

Extending radially outward from coupling 34 is a stop or projection 41 which is received within circumferentially extending slot 42 in the inner end of collar 21. Engagement of the stop 41 with the edges boardering the slot 42, will limit the rotation of sprinkler tube 22 relative to the housing 3.

Figure 7:
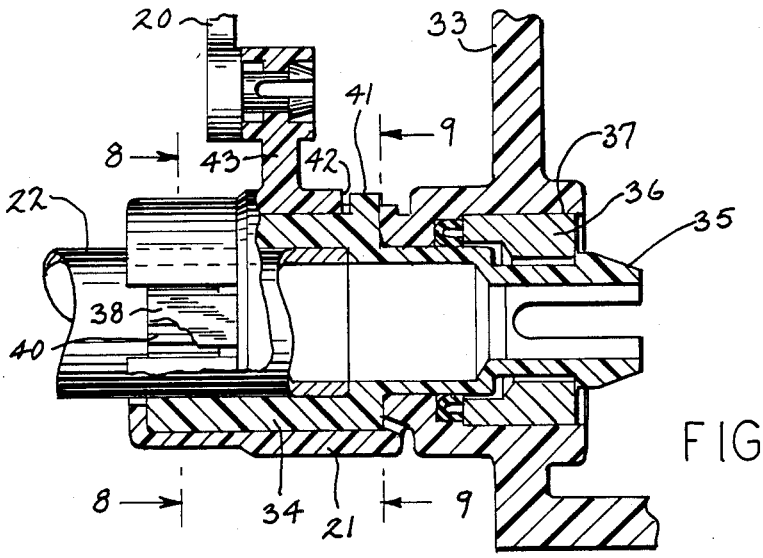
FIG. 7 :s a section taken along line 7—7 of FIG. 2.
Figure 8:
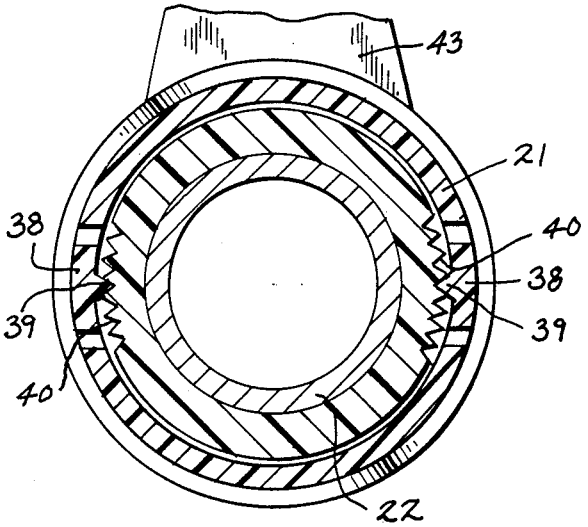
FIG. 8 is a section taken along line 8—8 of FIG. 7.
Figure 9:
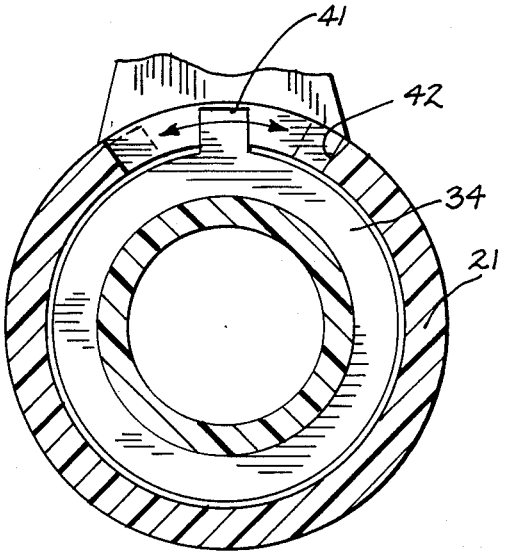
FIG. 9 is a section taken along line 9—9 of FIG. 7.

As best shown in FIGS. 7 and 8, collar 21 is provided with an outwardly extending lug 43 which is pivotally connected to the connecting rod 20.

Through the use of the elliptical gears 8 and 9, disc 12 is provided with a variable speed of rotation which balances out or compensates for the variable speed normally imparted by the crank arm. Thus the sprinkler tube 22 will have a substantially uniform velocity throughout the entire stroke of oscillation.

Through use of the slide 17 and the cam track 28 in the outer disc 15, the effective length A of the crank arm can be conveniently varied to thereby change the amplitude of the oscillating stroke through an arc of about 10° to 90°.

A further adjustment is accomplished by rotating the sprinkler tube 22 relative to the housing 2 to shift the spray pattern to either side as desired.

Various modes of carrying out the invention are contemplated as being within the scope of the following claims particularly pointing out and distinctly claiming the subject matter which is regarded as the invention.

I claim:

1. An improved oscillating sprinkler, comprising a frame, a housing mounted on the frame and having a water inlet fitting to be connected to a source of water under pressure, a sprinkler tube mounted for oscillating movement on the frame and having a plurality of water outlets, water supply means disposed within the housing for supplying water from said inlet fitting to said sprinkler tube, an output shaft driven by water flowing in said water supply means, crank arm means operably connected to the sprinkler tube to oscillate said tube through a given amplitude, a pair of elliptical gears, one of said gears being connected to said output shaft and the other of said gears being operably connected to said crank arm means, said elliptical gears being constructed and arranged so that the variable speed output of said other gear balances the variable speed output of said crank arm means to thereby oscillate said sprinkler tube with a substantially uniform velocity throughout its amplitude of oscillating movement, and slip clutch means interconnecting the sprinkler tube and the frame, said slip clutch means having a locking position to transmit oscillating movement of said crank arm means to said sprinkler tube and being constructed and arranged to permit manual rotation of said sprinkler tube relative to the frame to thereby shift the spray pattern.

2. An improved oscillating sprinkler, comprising a frame, a housing mounted on the frame and having a water inlet fitting to be connected to a source of water under pressure, a sprinkler tube mounted for oscillating movement on the frame and having a plurality of water outlets, water supply means disposed within said housing for supplying water from said inlet fitting to said sprinkler tube, an output shaft driven by water flowing in said water supply means and journalled for rotation with respect to said housing, a second shaft journalled with respect to said housing and spaced a fixed distance from said first shaft, a pair of elliptical gears, a first of said gears secured to said first shaft and a second of said gears being operably engaged with said first gear and being secured to said second shaft, and crank arm means operably interconnecting said second gear and said sprinkler tube to oscillate said tube through a given amplitude, the connection of said crank arm means to said second gear being offset from said second shaft, said elliptical gears being constructed and arranged so that the variable speed output of said second gear balances the variable speed output of said crank arm means, to thereby oscillate said sprinkler tube with a substantially uniform velocity throughout its amplitude of oscillating movement.

3. The sprinkler of claim 2, and including adjusting means for selectively varying the length of said crank arm means to change said amplitude.

4. An improved oscillating sprinkler, comprising a frame, a housing mounted on the frame and having a water inlet fitting to be connected to a source of water under pressure, a sprinkler tube mounted for oscillating movement on the frame and having a plurality of water outlets, water supply means disposed within the housing for supplying water from said inlet fitting to said sprinkler tube, an output shaft driven by water flowing in said water supply means, crank arm means operably connected to the sprinkler tube to oscillate said tube through a given amplitude, a pair of elliptical gears, one of said gears being to said output shaft and the other of said gears being connected operably connected to said crank arm means, said elliptical gears being constructed and arranged so that the variable speed output of said other gear balances the variable speed output of said crank arm means to thereby oscillate said sprinkler tube with a substantially uniform velocity throughout its amplitude of oscillating movement, said crank arm means including a rotatable member connected to said other gear, a slide mounted for movement relative to said rotatable member, a connecting rod pivotally connecting said slide to said sprinkler tube, and adjusting means for selectively varying the length of said crank arm means to change said amplitude, said adjusting means comprising means for moving the slide relative to said rotatable member to vary the distance between the axis of rotation of said rotatable member and the pivotal connection of said connecting rod to said slide.

5. The sprinkler of claim 4, wherein said rotatable member is a first disc and said adjusting means comprises a second disc, a cam track on said second disc, and a follower mounted on the slide and engageable with said cam track, rotation of said second disc relative to said first disc moving said slide relative to said first disc.

6. The sprinkler of claim 5, wherein said cam track is a spiral groove in said second disc.

7. An improved oscillating sprinkler, comprising a frame, a sprinkler tube mounted for oscillating movement on the frame and having a plurality of water outlets, water supply means for supplying water to said sprinkler tube, a rotatable member driven by water flowing in said water supply means and mounted for rotation relative to said frame, a movable member mounted for adjustable movement relative to said rotatable member, adjusting means for selectively moving the movable member relative to the rotatable member, and a connecting member pivotally connecting said movable member with said sprinkler tube, the pivotal connection of said connecting member to said movable member being offset from the axis of rotation of said rotatable member and constituting a crank arm to thereby provide oscillating movement for said sprinkler tube.

8. The sprinkler of claim 7, wherein said rotatable member comprises a disc, said movable member comprises a slide mounted for sliding movement on said disc and said connecting member is a connecting rod.

9. The sprinkler of claim 8, wherein said adjusting means comprises rotatable cam means mounted for manual relative rotation relative to said rotatable member.

10. The sprinkler of claim 9, wherein said rotatable cam means comprises a second rotatable member, a cam track on said second rotatable member, and a follower mounted on said slide, rotation of said second rotatable member relative to said first rotatable member moving said slide within the cam track to vary the position of the pivotal connection of said slide to said connecting rod with respect to the axis of rotation of said first rotatable member.

11. An improved oscillating sprinkler, comprising a frame, a sprinkler tube mounted for oscillating movement on the frame and having a plurality of water outlets spaced along the length of the tube, water supply means for supplying water to said sprinkler tube, a first disc driven by water flowing through said water supply means and mounted for rotation relative to said frame, a slide mounted for sliding movement relative to said first disc, a connecting rod pivotally connecting said slide to said sprinkler tube, and cam means for selectively moving said slide relative to said disc to vary the distance between the pivotal connection of said connecting rod and said slide relative to the axis of rotation of said disc and thereby vary the amplitude of oscillation of said sprinkler tube.

12. The sprinkler of claim 11, wherein said cam means comprises a second disc mounted coaxially with said first disc and including a cam track, and a follower mounted on the slide and engaged with said cam track.

13. An improved oscillating sprinkler, comprising a frame, a sprinkler tube mounted for oscillating movement on the frame and having a plurality of water outlets, water supply means for supplying water to the sprinkler tube, oscillating means for oscillating said sprinkler tube through a given arc, a coupling connected to an end of said sprinkler tube, means for journaling the coupling on said frame to permit oscillation of said sprinkler tube relative to said frame, a collar secured to said coupling, said collar being operably connected to said oscillating means, said collar having at least one radially flexible finger, and a plurality of serrations formed on said coupling and engageable with said finger, engagement of said finger with said serrations locking said collar to said coupling to permit said coupling and said sprinkler tube to oscillate with oscillation of said collar, and manual rotation of said sprinkler tube relative to said frame causing outward deflection of said finger to enable said sprinkler tube to be rotatably adjusted relative to said collar to thereby shift the arc of oscillation and the spray pattern.

14. The sprinkler of claim 15, wherein said coupling has a first end journalled to the frame and has a second end secured to said collar.

15. The sprinkler of claim 15, and including an inwardly extending projection on said finger to engage said serrations.

16. The sprinkler of claim 15, wherein said finger is defined by a pair of generally parallel slots.

17. The sprinkler of claim 15, and including means for limiting rotation of said sprinkler tube and coupling relative to said collar.

18. The sprinkler of claim 17, wherein said means for limiting rotation comprises a projection on said coupling, and a circumferential slot formed in said collar to receive said projection, engagement of said projection with the ends of said slot serving to limit rotation of said sprinkler tube.

* * * * *

UNITED STATES PATENT AND TRADEMARK OFFICE

CERTIFICATE OF CORRECTION

PATENT NO. : 4,877,185

DATED : October 31, 1989

INVENTOR(S) : FRED W. KUFRIN

It is certified that error appears in the above-identified patent and that said Letters Patent is hereby corrected as shown below:

Col. 7, line 13, CLAIM 14, Delete "15" and substitute therefor ---13---; Col. 8, line 1, CLAIM 15, Delete "15" and substitute therefor ---13---; Col. 8, line 4, CLAIM 16, Delete "15" and substitute therefor ---13---; Col. 8, Line 6, CLAIM 17, Delete "15" and substitute therefor ---13---

Signed and Sealed this

Thirtieth Day of July, 1991

*Attest:*

*Attesting Officer*

HARRY F. MANBECK, JR.

*Commissioner of Patents and Trademarks*